US011781440B2

(12) United States Patent
Vincent et al.

(10) Patent No.: US 11,781,440 B2
(45) Date of Patent: Oct. 10, 2023

(54) SCALLOPED MATEFACE SEAL ARRANGEMENT FOR CMC PLATFORMS

(71) Applicant: Raytheon Technologies Corporation, Farmington, CT (US)

(72) Inventors: Tyler G. Vincent, Portland, CT (US); Daniel Carlson, East Hampton, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 17/196,522

(22) Filed: Mar. 9, 2021

(65) Prior Publication Data

US 2022/0290574 A1 Sep. 15, 2022

(51) Int. Cl.

| | |
|---|---|
| ***F01D 11/00*** | (2006.01) |
| ***F01D 5/22*** | (2006.01) |
| *F01D 5/02* | (2006.01) |

(52) U.S. Cl.

CPC ..... *F01D 11/006* (2013.01); *F01D 5/22* (2013.01); *F01D 5/027* (2013.01); *F01D 5/225* (2013.01); *F01D 11/005* (2013.01); *F05D 2240/57* (2013.01); *F05D 2240/81* (2013.01)

(58) Field of Classification Search

CPC ..... F01D 5/225; F01D 5/22; F01D 11/006; F01D 11/005; F01D 11/008; F01D 9/041; F01D 5/143; F05D 2240/11; F05D 2240/81; F05D 2240/57

See application file for complete search history.

(56) References Cited

U.S. PATENT DOCUMENTS

| | | | | |
|---|---|---|---|---|
| 5,167,485 | A * | 12/1992 | Starkweather | F01D 11/005 415/115 |
| 5,338,152 | A * | 8/1994 | Feldmann | F01D 11/005 277/641 |
| 5,513,955 | A * | 5/1996 | Barcza | F01D 5/22 416/193 A |
| 6,261,053 | B1 * | 7/2001 | Anderson | F01D 11/04 415/115 |
| 7,581,931 | B2 * | 9/2009 | Shaefer | F01D 5/06 277/416 |
| 8,128,343 | B2 * | 3/2012 | Schiavo | F01D 11/005 415/116 |
| 8,162,598 | B2 * | 4/2012 | Liang | F01D 11/005 415/174.1 |
| 8,210,823 | B2 * | 7/2012 | Ward | F01D 11/006 416/220 R |

(Continued)

FOREIGN PATENT DOCUMENTS

| | | |
|---|---|---|
| GB | 2195403 | 4/1988 |
| JP | 2003129803 | 5/2003 |

OTHER PUBLICATIONS

European Search Report for European Patent Application No. 22159513.5 dated Aug. 5, 2022.

*Primary Examiner* — Woody A Lee, Jr.
*Assistant Examiner* — Behnoush Haghighian
(74) *Attorney, Agent, or Firm* — Carlson, Gaskey & Olds, P.C.

(57) ABSTRACT

A flow path component includes a platform that extends between a first side and a second side. A slot is in the first side. The slot divides the platform into a first portion and a second portion at the first side. There is a groove along the first side in the first portion.

18 Claims, 6 Drawing Sheets

(56) References Cited

U.S. PATENT DOCUMENTS 8,257,044 B2 * 9/2012 Hayasaka ..... F01D 11/006 416/189
8,376,697 B2 * 2/2013 Wiebe ..... F01D 11/005 415/173.7
8,388,309 B2 * 3/2013 Marra ..... F01D 11/005 415/171.1
9,291,065 B2 * 3/2016 Muller ..... F01D 11/005
9,334,738 B2 * 5/2016 Nereim ..... F01D 5/06
9,347,322 B2 * 5/2016 Gurao ..... F01D 5/06
9,808,889 B2 * 11/2017 Mitchell ..... B23K 33/004
9,845,697 B2 * 12/2017 Davis ..... F01D 25/246
9,920,644 B2 3/2018 McKenna
10,370,987 B2 8/2019 Sakamoto
10,370,993 B2 * 8/2019 Davis ..... F01D 11/005
10,458,264 B2 * 10/2019 Mongillo, Jr. ..... F01D 25/246
10,648,362 B2 * 5/2020 Groves, II ..... F01D 11/005
10,655,495 B2 * 5/2020 Groves, II ..... F01D 25/12
11,098,606 B2 * 8/2021 Davis ..... F16J 15/104
2009/0148298 A1 * 6/2009 Strohl ..... F01D 5/3007 416/219 R
2013/0011265 A1 * 1/2013 Miller ..... F01D 9/041 416/191
2013/0177383 A1 * 7/2013 Winn ..... F01D 11/005 415/1
2013/0315745 A1 11/2013 Aggarwala
2016/0115814 A1 * 4/2016 Davis ..... F16J 15/104 277/591
2016/0326898 A1 * 11/2016 Mongillo, Jr. ..... F01D 11/006
2016/0362996 A1 * 12/2016 Ahmad ..... F01D 17/08
2018/0340437 A1 * 11/2018 Groves, II ..... F01D 11/005
2018/0355741 A1 * 12/2018 Groves, II ..... F01D 25/12
2018/0355754 A1 * 12/2018 Groves, II ..... F01D 11/005
2018/0371947 A1 * 12/2018 Sippel ..... F01D 11/005
2019/0353044 A1 * 11/2019 Davis ..... F16J 15/08
2020/0191005 A1 * 6/2020 Hillier ..... F01D 11/005
2021/0062667 A1 * 3/2021 Mongillo, Jr. ..... F01D 11/005

* cited by examiner

SCALLOPED MATEFACE SEAL ARRANGEMENT FOR CMC PLATFORMS

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section The compressor or turbine sections may include vanes mounted on vane platforms. Seals may be arranged between matefaces of adjacent components to reduce leakage to the high-speed exhaust gas flow.

SUMMARY OF THE INVENTION

In one exemplary embodiment, a flow path component includes a platform that extends between a first side and a second side. A slot is in the first side. The slot divides the platform into a first portion and a second portion at the first side. There is a groove along the first side in the first portion.

In a further embodiment of any of the above, the first portion is a radially outer portion and the second portion is a radially inner portion.

In a further embodiment of any of the above, the groove is a semicircle.

In a further embodiment of any of the above, a plurality of grooves is provided along the first side in the first portion.

In a further embodiment of any of the above, the groove does not extend into the second portion In a further embodiment of any of the above, the slot is configured to receive a feather seal.

In a further embodiment of any of the above, the groove is configured to communicate cooling air into the slot.

In a further embodiment of any of the above, the component is a ceramic material.

In a further embodiment of any of the above, the component is a vane platform.

In another exemplary embodiment, a flow path component assembly includes a flow path component that has a plurality of segments that extend circumferentially about an axis. At least one of the segments has a platform that extends between a first side and a second side. There is a slot in the first side that divides the platform into a first portion and a second portion. There is a groove along the first side in the first portion.

In a further embodiment of any of the above, a plurality of grooves are spaced axially along the first side in the first portion.

In a further embodiment of any of the above, a feather seal is arranged in the slot.

In a further embodiment of any of the above, the groove has a diameter that is less than a width of the feather seal In a further embodiment of any of the above, the groove has a diameter that is between about 50% and about 90% of a width of the feather seal.

In a further embodiment of any of the above, the feather seal is a metallic material.

In a further embodiment of any of the above, cooling air is configured to flow through the groove to the feather seal.

In a further embodiment of any of the above, each of the plurality of segments has the slot in the first side and a second slot in the second side. A feather seal is arranged between each of the plurality of segments in the first and second slots.

In a further embodiment of any of the above, the groove along the first side is aligned with a second groove along the second side.

In a further embodiment of any of the above, the groove along the first side is offset from a second groove along the second side.

In a further embodiment of any of the above, the at least one segment is formed from a ceramic material.

DETAILED DESCRIPTION

Figure 1:
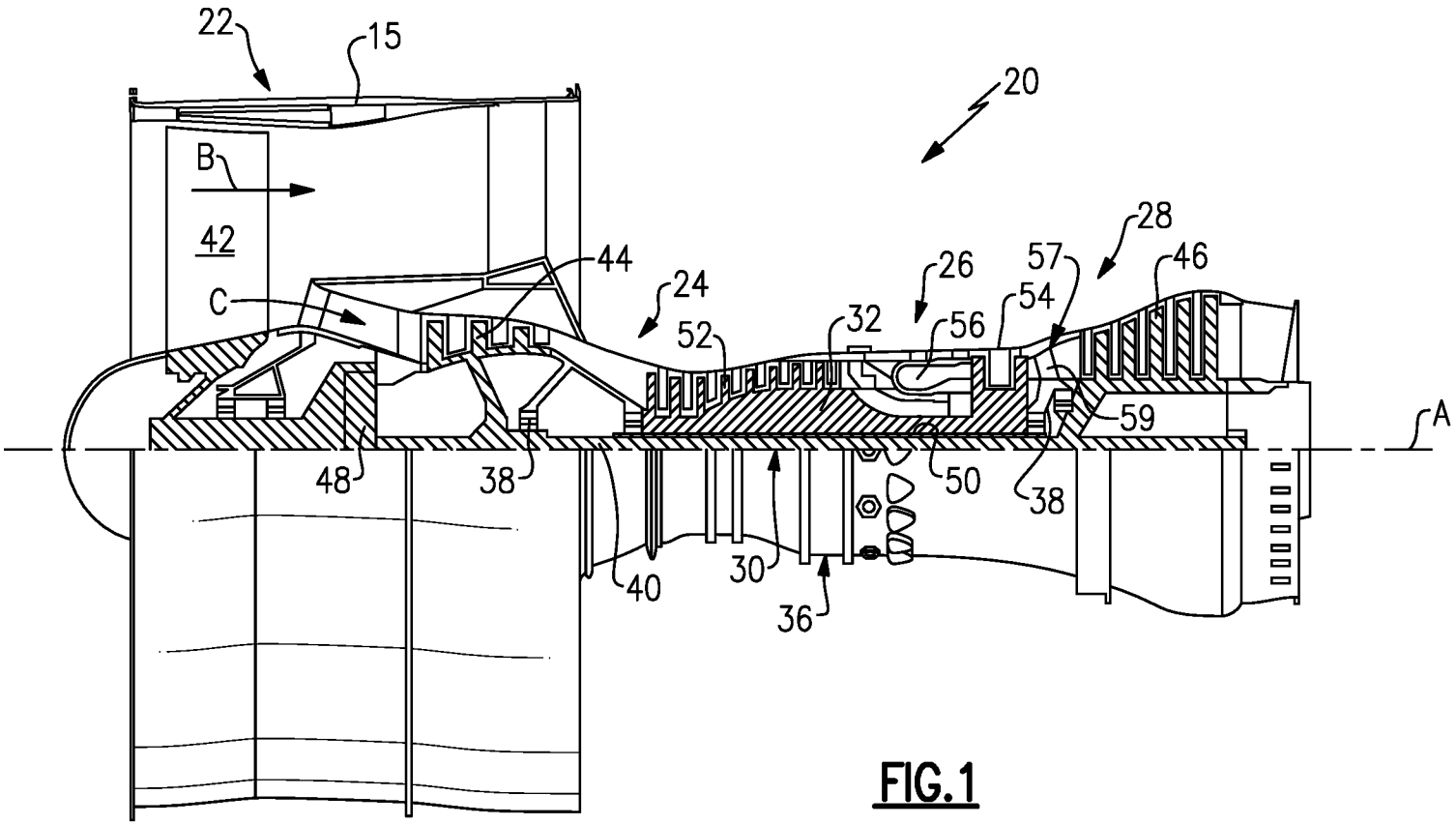
FIG. 1 schematically illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 meters/second).

Figure 2:
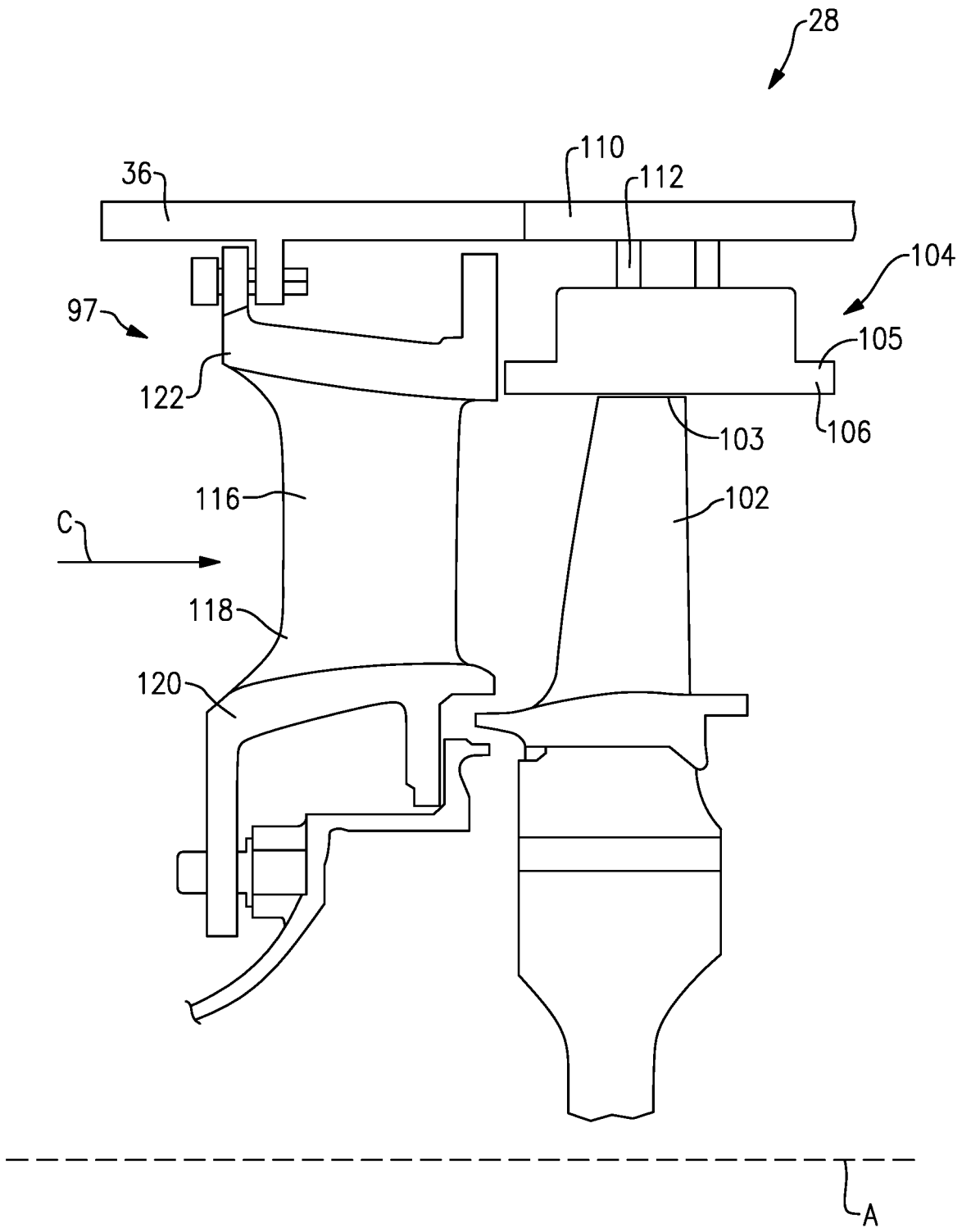
FIG. 2 schematically illustrates an example turbine section.

FIG. 2 shows a portion of an example turbine section 28, which may be incorporated into a gas turbine engine such as the one shown in FIG. 1. However, it should be understood that other sections of the gas turbine engine 20 or other gas turbine engines, and even gas turbine engines not having a fan section at all, could benefit from this disclosure. The turbine section 28 includes a plurality of alternating turbine blades 102 and turbine vanes 97.

A turbine blade 102 has a radially outer tip 103 that is spaced from a blade outer air seal assembly 104 with a blade outer air seal ("BOAS") 106. The BOAS 106 may be mounted to an engine case or structure, such as engine static structure 36 via a control ring or support structure 110 and a carrier 112. The engine structure 36 may extend for a full 360° about the engine axis A.

The turbine vane assembly 97 generally comprises a plurality of vane segments 118. In this example, each of the vane segments 118 has an airfoil 116 extending between an inner vane platform 120 and an outer vane platform 122.

Figure 3:
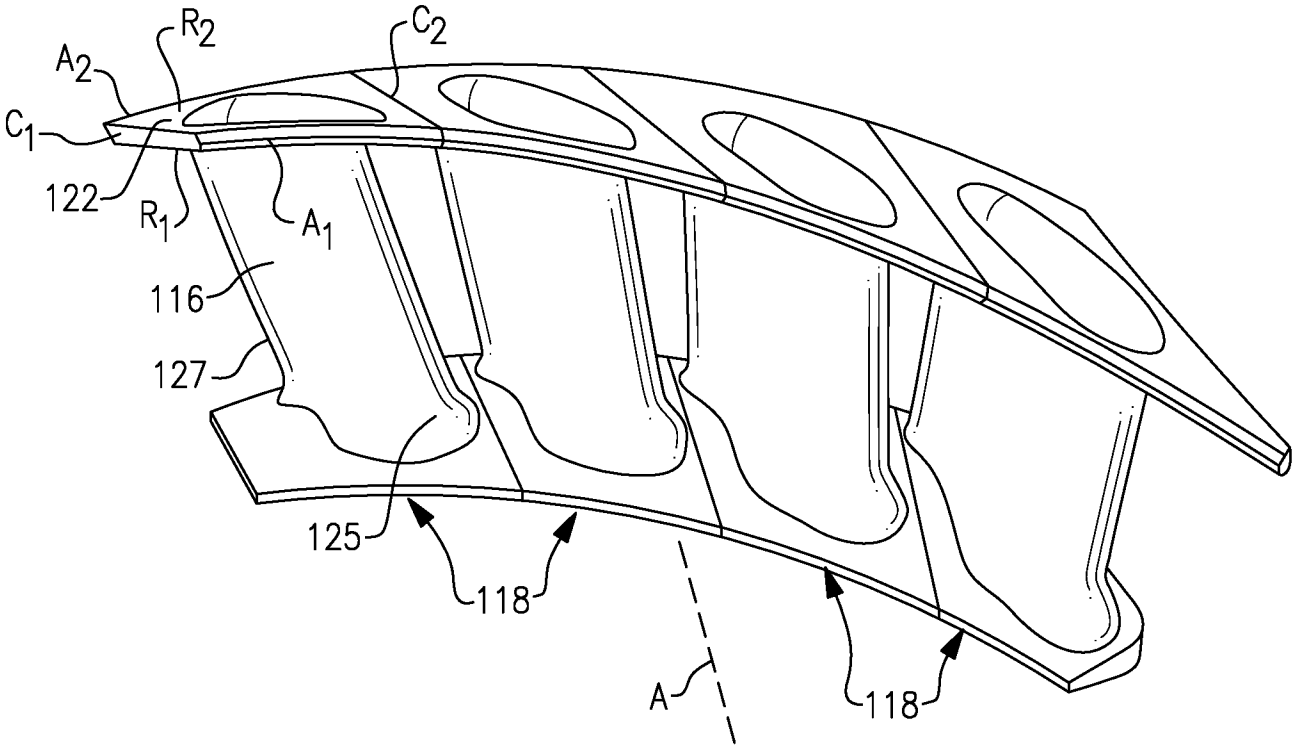
FIG. 3 illustrates a portion of a vane ring assembly.

FIG. 3 illustrates a portion of the vane ring assembly 97 from the turbine section 28 of the engine 20. The vane ring assembly 97 is made up of a plurality of vanes 118 situated in a circumferential row about the engine central axis A. Although the vane segments 118 are shown and described with reference to application in the turbine section 28, it is to be understood that the examples herein are also applicable to structural vanes in other sections of the engine 20, and other structures, such as BOAS 106.

The vane segment 118 has an outer platform 122 radially outward of the airfoil. Each platform 122 has radially inner and outer sides R1, R2, respectively, first and second axial sides A1, A2, respectively, and first and second circumferential sides C1, C2, respectively. The radially inner side R1 faces in a direction toward the engine central axis A. The radially inner side R1 is thus the gas path side of the outer vane platform 122 that bounds a portion of the core flow path C. The first axial side A1 faces in a forward direction toward the front of the engine 20 (i.e., toward the fan 42), and the second axial side A2 faces in an aft direction toward the rear of the engine 20 (i.e., toward the exhaust end). In other words, the first axial side A1 is near the airfoil leading end 125 and the second axial side A2 is near the airfoil trailing end 127. The first and second circumferential sides C1, C2 of each platform 122 abut circumferential sides C1, C2 of adjacent platforms 122. In this example, a mateface seal is arranged between circumferential sides C1, C2 of adjacent platforms, as will be described further herein.

Although a vane platform 122 is described, this disclosure may apply to other components, and particularly flow path components. For example, this disclosure may apply to combustor liner panels, shrouds, transition ducts, exhaust nozzle liners, blade outer air seals, or other CMC components. Further, although the outer vane platform 122 is generally shown and referenced, this disclosure may apply to the inner vane platform 120.

The vane platform 122 may be formed of a ceramic matrix composite ("CMC") material. Each platform 122 is formed of a plurality of CMC laminate sheets. The laminate sheets may be silicon carbide fibers, formed into a braided or woven fabric in each layer. In other examples, the vane platform 122 may be made of a monolithic ceramic. CMC components such as vane platforms 120 are formed by laying fiber material, such as laminate sheets or braids, in tooling, injecting a gaseous infiltrant into the tooling, and reacting to form a solid composite component. The component may be further processed by adding additional material to coat the laminate sheets. CMC components may have higher operating temperatures than components formed from other materials.

Figure 4:
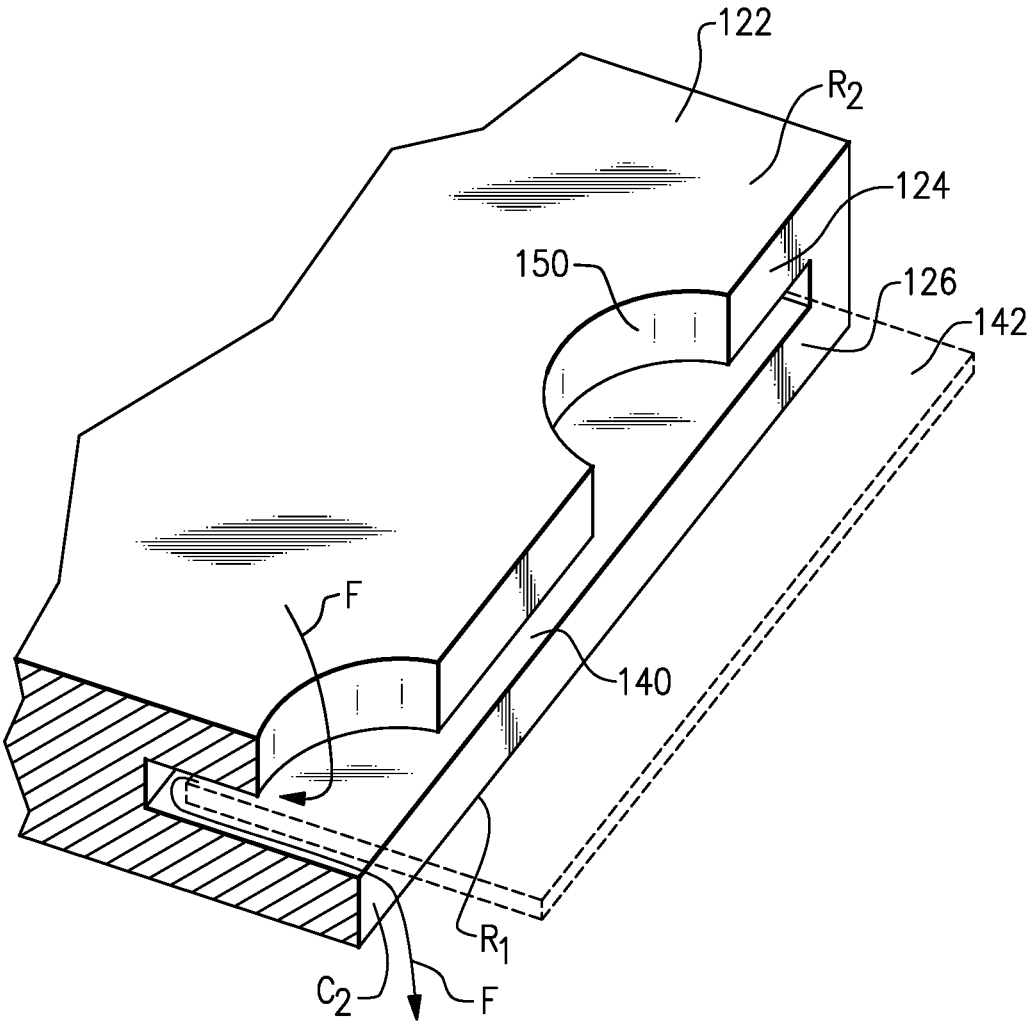
FIG. 4 illustrates a cut away view of a portion of an exemplary vane platform.

FIG. 4 illustrates a cut away view of an example mateface seal arrangement, such as between adjacent platforms 122.

The platform 122 includes a feather seal slot 140. The feather seal slot 140 may be about halfway between the radially inner and outer sides R1, R2. The slot 140 extends along the platform 122 in the axial direction. The slot 140 generally divides the platform 122 into an outer portion or cold side 124 and an inner portion or hot side 126. The hot side 126 is closest to the core flow path C. A feather seal 142 may be arranged in the slot 140. About half of the feather seal 142 is arranged in the slot 140, and the other half will be arranged in a slot 140 of an adjacent component when assembled. Although a flat feather seal 142 is shown, a curved, bent, or other feather seal configuration may be utilized. The feather seal 142 may be a metallic component such as a cobalt material, for example.

A plurality of scallops or grooves 150 are arranged in the cold side 124 of the platform 122. The grooves 150 expose the feather seal 142 to cooling air adjacent the cold side 124 of the platform 122. A flow of cooling air F may flow to the feather seal 142 through the grooves 150. In the illustrated example, the flow F enters the slot 140 through the groove 150 and impinges on the feather seal 142. The flow F may be introduced to the feather seal 142 via channel flow or impingement jets, for example.

Figure 5:
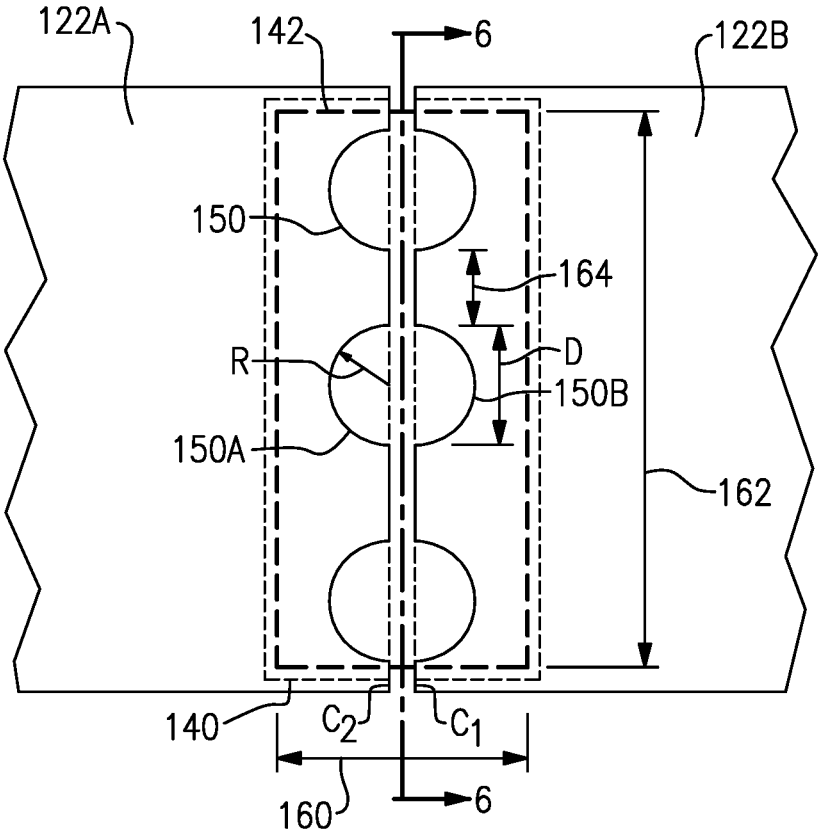
FIG. 5 illustrates a top view of a portion of an exemplary vane platform.

FIG. 5 schematically illustrates a top view of the example mateface seal arrangement. When assembled, the feather seal 142 is arranged in a slot 140 of two adjacent platforms 122A, 122B. Each of the platforms 122A, 122B has a slot 140 in each circumferential side C1, C2, such that a feather seal 142 is arranged between each platform 122 when the segments 118 are arranged circumferentially about the engine axis A. In other words, a single feather seal 142 is arranged in a slot 140 in the second circumferential side C2 of a first platform 122A and the first circumferential side C1 of the second platform 122B. Each of the first and second circumferential sides C1, C2 of the first and second platforms 122A, 122B may have grooves 150.

The grooves 150 provide surface area for active cooling air to reach the feather seal 142. In the illustrated example, the groove 150 is a semicircle having a radius R and diameter D. The feather seal 142 has a width 160 in the circumferential direction, and a length 162 in the axial direction. In one example, the diameter D of the groove 150 is about 50% to 90% of the width 160 of the feather seal 142. Although a semicircular groove 150 is illustrated, the groove 150 may be other shapes, such as an arc, an oval, or a rectangle, for example. The grooves 150 in a platform 122A are spaced apart by a distance 164. In this example, the distance 164 may be smaller than the diameter D. Although a particular groove diameter and spacing is shown, other arrangements may fall within the scope of this disclosure. For example, feather seals 142 that need additional cooling may have a smaller distance 164 and/or a larger diameter D to provide additional cooling to the feather seal 142.

In the illustrated embodiment, the grooves 150A in the platform 122A are aligned with grooves 150B in an adjacent platform 122B. However, in other examples, the grooves 150A may be offset from the grooves 150B. The grooves 150A, 150B in adjacent platforms 122A, 122B are on opposite sides of the platform. In other words, each platform 122A, 122B has a slot 140 and plurality of grooves 150 on each circumferential side C1, C2.

Figure 6:
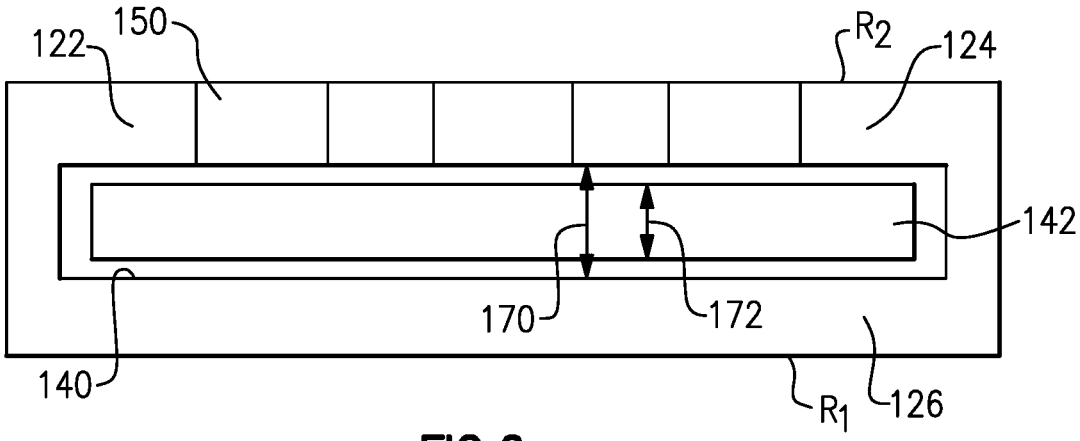
FIG. 6 illustrates a cross-sectional view of a portion of the exemplary vane platform.

FIG. 6 illustrates a cross-sectional view along line 6-6 from FIG. 5. The grooves 150 extend all the way through the cold side 124 of the platform 122, but do not extend through the hot side 126. In other words, the grooves 150 extend from the second radial side R2 to the slot 140. In some examples, the slot 140 has a thickness 170 in the axial direction that is larger than a thickness 172 of the feather seal 142. Although a particular feather seal arrangement is shown at a circumferential mateface, the disclosed arrangement may be used in other assemblies. The grooved arrangement may be used at a leading or trailing edge in an L-seal, for example.

Figure 7:
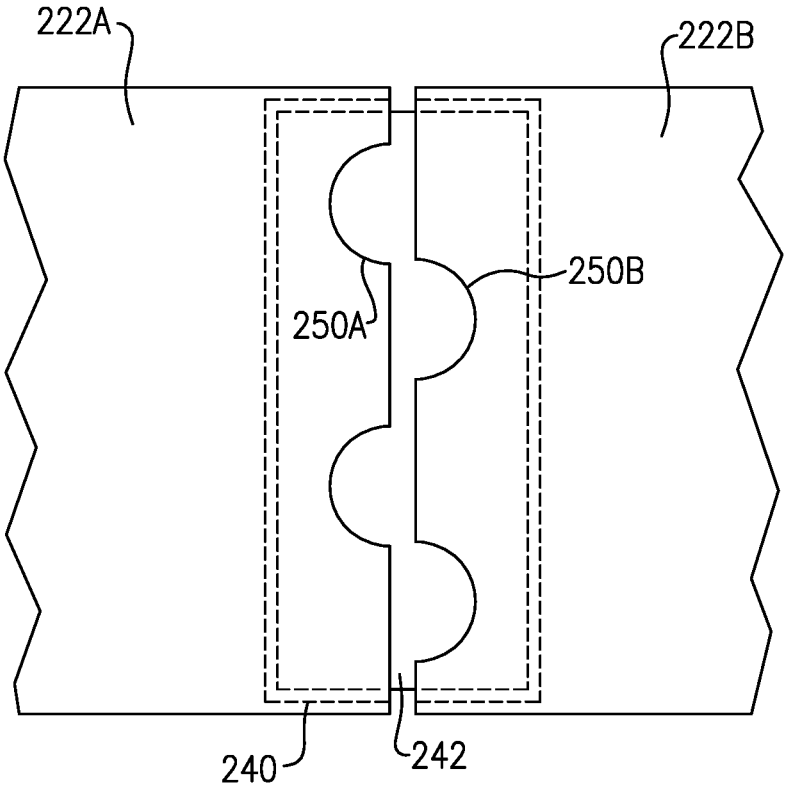
FIG. 7 illustrates a portion of another exemplary vane platform.

FIG. 7 illustrates another example mateface seal arrangement. In this example, the grooves 250A in the first platform 222A are offset from the grooves 250B in the second platform 222B in the axial direction.

Feather seals are used to limit cooling air leakage to the core flow path, which may improve engine efficiency. Known feather seals may be susceptible to overheating because of their proximity to the core flow path C. Further, CMC components have higher temperature capabilities, and thus feather seals used with CMC components may be exposed to higher temperatures. The disclosed arrangement exposes portions of the feather seal to enable cooling to be applied directly to the feather seal. This active cooling arrangement helps prevent overheating of the feather seal and may increase seal durability and extend operational life of the component. The ability to use a feather seal in an axial slot may also decrease component complexity by eliminating the need for additional features to hold an intersegment seal in place. The material removed to form the grooves 150 may also reduce part weight.

In this disclosure, "generally axially" means a direction having a vector component in the axial direction that is greater than a vector component in the circumferential direction, "generally radially" means a direction having a vector component in the radial direction that is greater than a vector component in the axial direction and "generally circumferentially" means a direction having a vector component in the circumferential direction that is greater than a vector component in the axial direction.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A flow path component, comprising:

a platform extending circumferentially between a first side and a second side;

a slot in the first side, the slot extending circumferentially and axially to divide the platform into a first portion and a second portion at the first side, the second portion including a hot side surface dimensioned to bound a core flow path, and the first portion including a cold side surface on an opposite side of the platform;

a groove along the first side in the first portion, wherein the groove is a semicircle, wherein the groove is one of a plurality of grooves provided along the first side in the first portion, and wherein the groove is circumferentially and axially aligned with, but is spaced apart from, the second portion of the platform; and wherein the groove extends circumferentially inward from the first side to establish a first width, the slot extends circumferentially inward from the first side to establish a second width, and the second width is greater than the first width such that the slot extends circumferentially past the groove.

2. The flow path component of claim 1, wherein the first portion is a radially outer portion and the second portion is a radially inner portion.

3. The flow path component of claim 1, wherein the slot is configured to receive a feather seal.

4. The flow path component of claim 1, wherein the groove is configured to communicate cooling air into the slot.

5. The flow path component of claim 1, wherein the component is a ceramic material.

6. The flow path component of claim 1, wherein the component is a vane platform.

7. A flow path component assembly, comprising:

a flow path component having a plurality of segments extending circumferentially about an axis to bound a core flow path;

at least one of the segments having a platform extending circumferentially between a first side and a second side, a slot in the first side, the slot extending circumferentially and axially to divide the platform into a first portion and a second portion, and a groove along the first side in the first portion, wherein the groove is a semicircle, wherein the second portion includes a hot side surface bounding the core flow path, the first portion includes a cold side surface on an opposite side of the platform, wherein the groove is circumferentially and axially aligned with, but is spaced apart from, the second portion of the platform, and wherein the semicircle groove is one of a plurality of grooves spaced axially along the first side in the first portion; and wherein the groove extends circumferentially inward from the first side to establish a first width, the slot extends circumferentially inward from the first side to establish a second width, and the second width is greater than the first width such that the slot extends circumferentially past the groove relative to the axis.

8. The flow path component assembly of claim 7, wherein a feather seal is arranged in the slot.

9. The flow path component assembly of claim 8, wherein the groove has a diameter that is less than a width of the feather seal.

10. The flow path component assembly of claim 8, wherein the groove has a diameter that is between about 50% and about 90% of a width of the feather seal.

11. The flow path component assembly of claim 8, wherein the feather seal is a metallic material.

12. The flow path component assembly of claim 8, wherein cooling air is configured to flow through the groove to the feather seal.

13. The flow path component assembly of claim 7, wherein each of the plurality of segments has the slot in the first side and a second slot in the second side, and a feather seal is arranged between each of the plurality of segments in the first and second slots.

14. The flow path component assembly of claim 13, wherein the groove along the first side is aligned with a second groove along the second side.

15. The flow path component assembly of claim 13, wherein the groove along the first side is offset from a second groove along the second side.

16. The flow path component assembly of claim 7, wherein the at least one segment is formed from a ceramic material.

17. The flow path component of claim 1, wherein the plurality of grooves are spaced apart from one another by a distance that is smaller than a diameter of the semicircle groove.

18. The flow path component assembly of claim 13, wherein a second plurality of grooves is spaced axially along the second side in the first portion.

* * * * *